US007200959B2

(12) United States Patent
Spann

(10) Patent No.: US 7,200,959 B2
(45) Date of Patent: Apr. 10, 2007

(54) MODIFIABLE FOOTWEAR

(76) Inventor: Linda Spann, 170 Butterfly La., Santa Barbara, CA (US) 93108

( * ) Notice: Subject to any disclaimer, the term of this patent is extended or adjusted under 35 U.S.C. 154(b) by 297 days.

(21) Appl. No.: 10/936,097

(22) Filed: Sep. 7, 2004

(65) Prior Publication Data

US 2006/0048408 A1 Mar. 9, 2006

(51) Int. Cl.
*A43B 23/00* (2006.01)

(52) U.S. Cl. ..... 36/136; 36/11.5

(58) Field of Classification Search ..... 36/136, 36/1, 112, 11, 5, 100, 15; 2/244, 245
See application file for complete search history.

(56) References Cited

U.S. PATENT DOCUMENTS 1,583,274 A * 5/1926 Bostock ..... 36/136
1,596,384 A * 8/1926 Williams ..... 2/245
2,612,135 A * 9/1952 Iny ..... 116/170
3,011,281 A 12/1961 King
3,032,896 A 5/1962 Weaver
4,172,330 A 10/1979 Kao
4,193,214 A 3/1980 Wang
4,461,102 A * 7/1984 DeVincentis ..... 36/101
4,485,496 A 12/1984 Shanks, Jr.
4,525,940 A 7/1985 Mochizuki
4,712,319 A 12/1987 Goria
4,869,000 A 9/1989 York, Jr.
5,136,726 A * 8/1992 Kellin et al. ..... 2/244
5,456,032 A * 10/1995 Matsumoto et al. ..... 40/636
5,496,612 A 3/1996 Ransbottom
5,673,501 A 10/1997 Mathews
5,729,834 A * 3/1998 Sloot ..... 2/243.1
5,800,900 A 9/1998 Mitchell
5,802,738 A 9/1998 Ferniani
5,839,211 A 11/1998 Pallera
5,852,885 A 12/1998 Ferniani
5,896,585 A * 4/1999 Stazo ..... 2/209.13
6,115,948 A 9/2000 Mitchell
6,216,279 B1 * 4/2001 Ellingson ..... 2/239
6,349,486 B1 2/2002 Lin
6,430,846 B1 * 8/2002 Lin ..... 36/101
6,769,204 B1 8/2004 Phillips
6,848,199 B1 2/2005 Giannelli
2004/0093765 A1 * 5/2004 Baldwin ..... 36/101
2006/0007668 A1 * 1/2006 Chien ..... 362/103
2006/0107550 A1 * 5/2006 Caminiti ..... 36/11.5

* cited by examiner

*Primary Examiner*—Marie Patterson
(74) *Attorney, Agent, or Firm*—Brinks Hofer Gilson & Lione

(57) ABSTRACT

Footwear having a sole, a retaining strap, and at least one decorative piece is provided. The retaining strap is attached to the sole, and the decorative pieces are releasably attached to the retaining strap, thereby allowing a wearer to remove and replace the decorative pieces in an interchangeable manner. The interchangeability of the decorative pieces allows the wearer to easily modify the visual appearance of the footwear.

20 Claims, 4 Drawing Sheets

MODIFIABLE FOOTWEAR

TECHNICAL FIELD

The present invention relates to the field of footwear, and more particularly to footwear that can be modified by a wearer.

BACKGROUND OF THE INVENTION

Footwear is typically designed to be stylish, comfortable, ergonomic, and/or practical. However, each pair of footwear is usually limited to its appearance at the time it is purchased, thereby limiting the occasions when the footwear can be worn. The type of footwear purchased is generally dependent upon the occasion in which the footwear is going to be worn, or the general appearance of the particular footwear. This requires a wearer to purchase several different types of footwear in order to have a wide variety of footwear from which to choose for various occasions or appearances. Accordingly, there is a need for footwear that can be modified by the wearer to provide a multitude of occasions for which the footwear can be worn, and also allow the wearer to modify the appearance of the footwear for their own personal preference.

BRIEF SUMMARY OF THE INVENTION

In order to address the need for footwear having interchangeability to provide a variety of visual appearances of the footwear, modifiable footwear having a sole, a foot retaining strap attached to the sole, and at least one decorative piece removably connected to the foot retaining strap, is described below. According to another aspect of the invention, the decorative piece is hollow and has an orifice formed therein, the foot retaining strap includes a receiving member, and the receiving member is inserted into the hollow main body of the decorative piece through the orifice.

According to another aspect of the invention, the decorative piece includes a protrusion extending therefrom, the foot retaining strap includes a receiving member, and the receiving member of the foot retaining strap is adapted to receive the protrusion of the decorative piece. In another aspect of the invention, the decorative piece is removably attached to the foot retaining strap.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
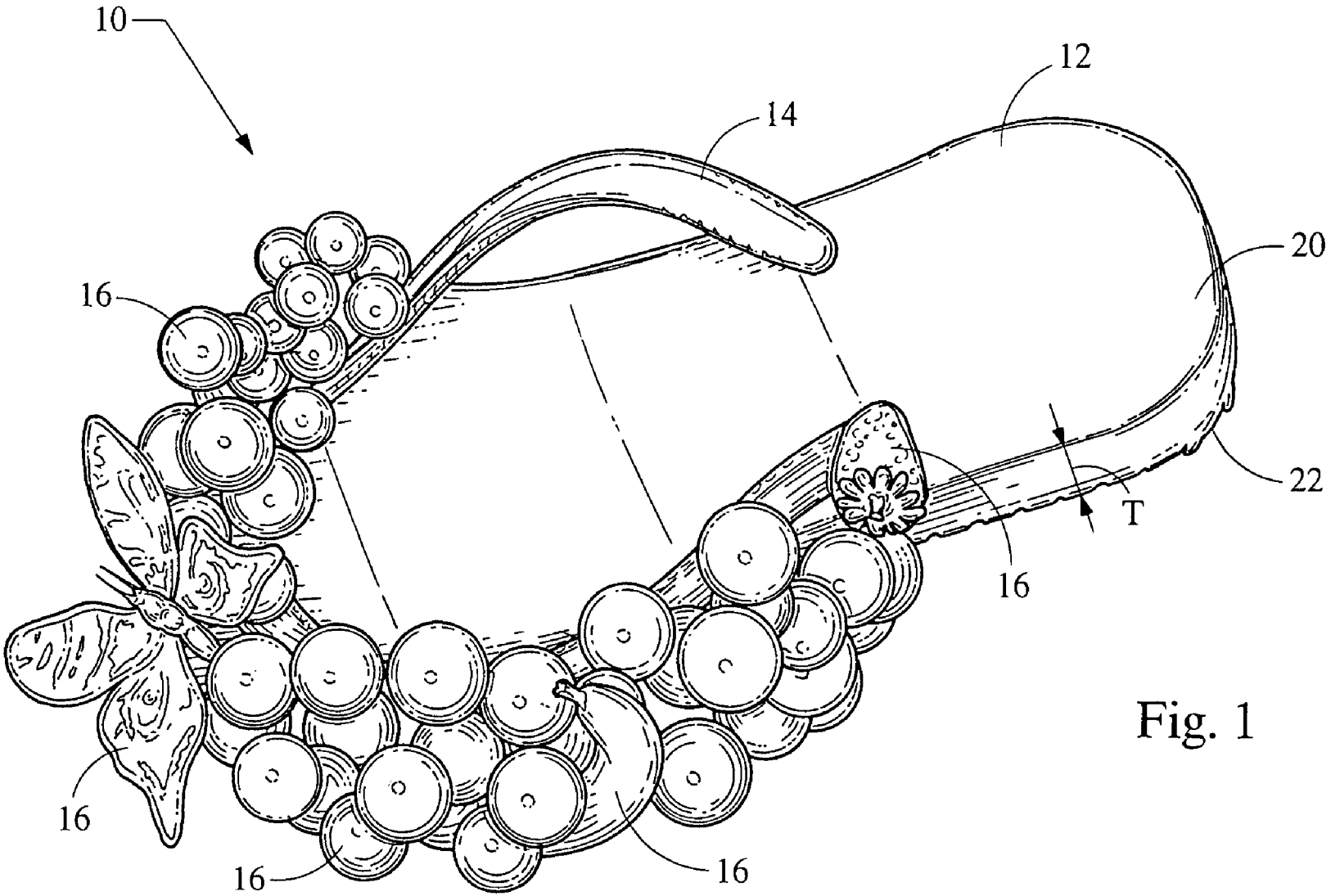
FIG. 1 is a top perspective view of one embodiment of the modifiable footwear of the present invention.

Referring to FIG. 1, one embodiment of modifiable footwear 10 of the present invention is shown. The modifiable footwear 10 provides the wearer the capability to remove decorative pieces from the footwear, thereby allowing the appearance of the modifiable footwear 10 to be easily changed.

The modifiable footwear 10 preferably includes a sole 12, a retaining strap 14, and at least one decorative piece 16. The sole 12 provides a barrier between the wearer's foot and the ground. The foot retaining strap 14 is attached to the sole 12 and is configured to maintain a wearer's foot in wearable contact with the modifiable footwear 10. Preferably, a plurality of decorative pieces 16 are removably connected to the retaining strap 14 to provide the modifiable footwear 10 with a changeable appearance.

Figure 2:
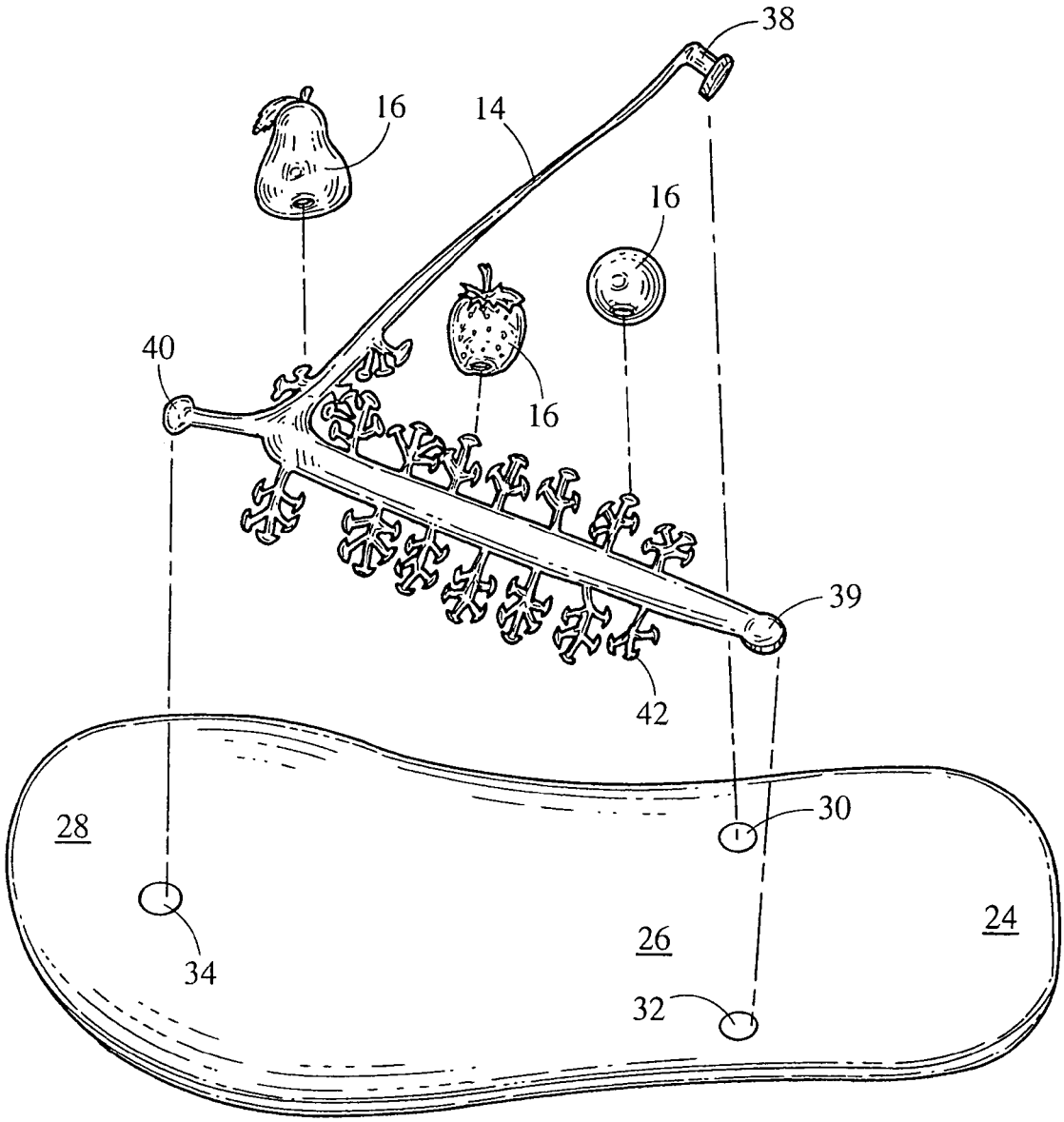
FIG. 2 is an exploded view of the modifiable footwear of FIG. 1.

The sole 12, as illustrated in FIGS. 1–2, has a top surface 20 and a bottom surface 22, wherein the top surface 20 is a generally smooth surface and the bottom surface 22 is a textured surface. It should be understood by one skilled in the art that both the top and bottom surfaces 22, 24 can be either smooth or textured. The sole 12 is generally in the shape of the outline of a foot such that the sole 12 has a heel portion 24, a toe portion 28, and a midsole portion 26 spanning between the heel and toe portions 24, 28. The sole 12 is preferably made of a flexible material to allow the sole 12 to be flexed while the wearer walks. The sole 12 can be made of foam rubber, plastic, or any other material sufficient to provide flexure during use. Among other factors, the flexibility of the sole 12 is also dependent upon the thickness T. The thickness T is preferably sufficient to provide a cushioned support to the wearer's foot yet allow for the sole to bend during walking. However, it should be understood by one skilled in the art that the sole can have any thickness, and the sole need not be bendable.

The sole 12 includes a first aperture 30 and a second aperture 32, shown in FIG. 2, that extend from the top surface 20 through at least a portion of the thickness T of the sole 12. The first and second apertures 30, 32 are preferably disposed on the midsole portion 26, wherein one of the first or second apertures 30, 32 is located adjacent to the medial side of the sole 12, or instep, and the other aperture is located adjacent to the lateral side of the sole 12. The sole 12 further includes a third aperture 34 located on the toe portion 28 of the sole 12, and extends from the top surface 20 through at least a portion of the thickness T. The first, second, and third apertures 30, 32, 34 preferably extend only a partially into the thickness of the sole 12, but it should be understood by one skilled in the art that the apertures can extend through the entire thickness such that a hole is formed between the top surface 20 and bottom surface 22. of the sole 12. The first, second, and third apertures 30, 32, 34 are each configured to receive the retaining strap 14 in order to maintain contact between the sole 12, retaining strap 14, and a wearer's foot in a surrounding manner.

Figure 3:
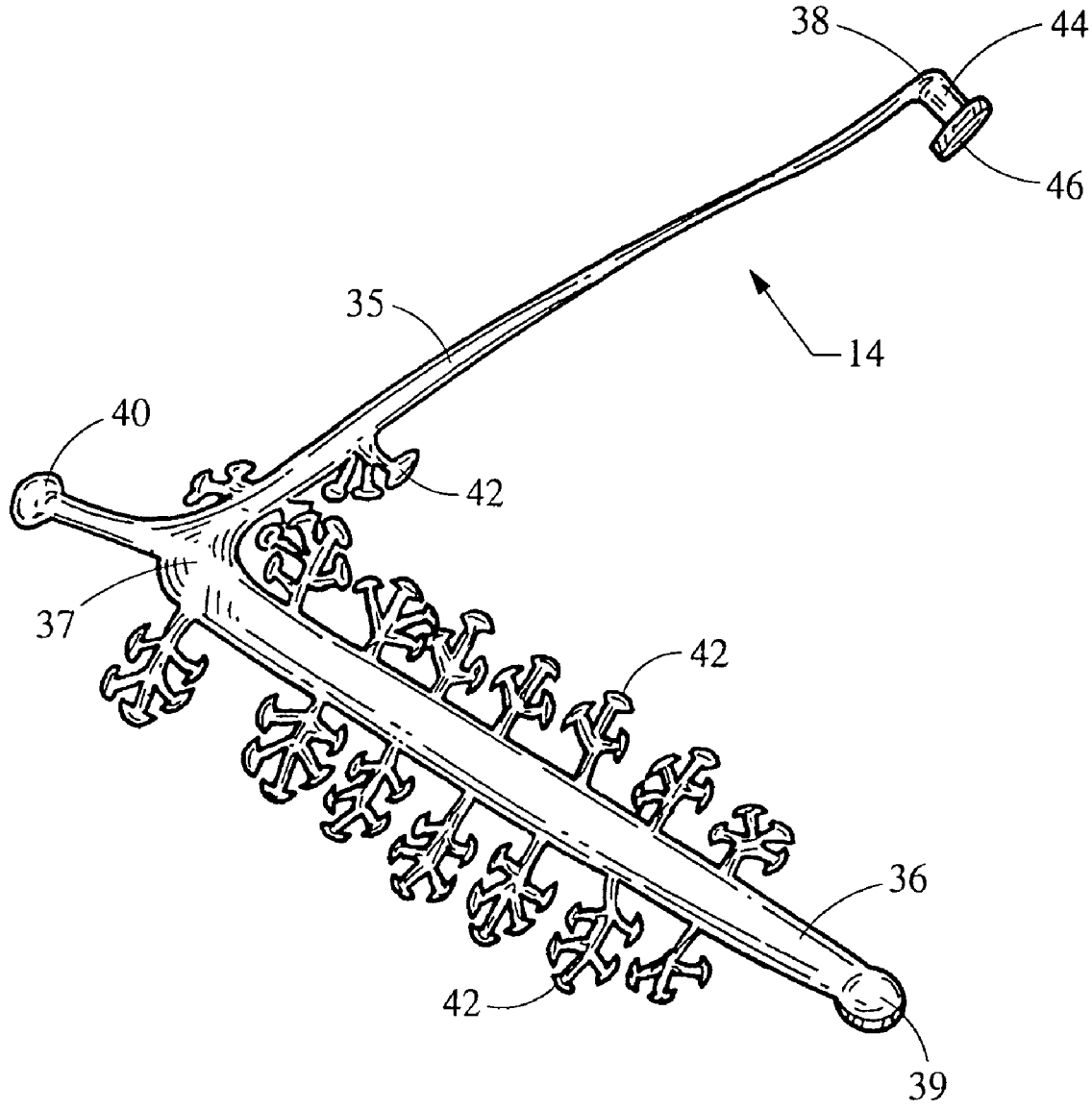
FIG. 3 is a top view of a retaining strap.

The retaining strap 14 is formed of a first arm 35, a second arm 36, a first distal end 38, a second distal end 39, a third distal end 40, and at least one receiving member 42, as illustrated in FIGS. 2–3. The retaining strap 14 is generally V-shaped, wherein the first arm 35 and second arm 36 are joined at a proximal point 37, and the first arm 35 and second arm 36 are oriented at an angle with respect to each other relative to the proximal point 37. The first distal end 38 is disposed at the end of the first arm 35 opposite the proximal point 37. The second distal end 39 is disposed at the end of the second arm 36 opposite the proximal point 37. The third distal end 40 extends from the proximal point 37 at an angle with respect to both the first arm 35 and second arm 36 relative to the proximal point 37. The first aperture 30 of the sole 12 is configured to receive the first distal end 38 of the retaining strap 14; the second aperture 32 of the sole 12 is configured to receive the second distal end 39 of the retaining strap 14; and the third aperture 34 of the sole 12 is configured to receive the third distal end 40 of the retaining strap 14. The third distal end 40 is connected to the toe portion 28 of the sole 12 in a location that is generally between the first and second toes of the wearer. The first arm 35 therefore provides support to the top of the wearer's foot extending from the toe portion 28 toward the instep, and the second arm also provides support to the top of the wearer's foot extending from the toe portion 28 toward the outstep.

In a preferred embodiment, the modifiable footwear 10 are constructed such that the first, second, and third apertures 30, 32, 34 extend only partially into the thickness T of the sole 12. The first, second, and third distal ends 38, 39, 40 are inserted into the respective apertures and are integrally formed with the apertures in the sole such that the retaining strap 14 is fixedly connected to the sole 12. The distal ends 38, 39, 40 of the retaining strap 14 are preferably glued into the corresponding apertures 30, 32, 34 of the sole 12. It should be understood by one skilled in the art that any other method of fixedly attaching the retaining strap 14 to the sole 12 can be used.

In an alternative embodiment, each distal end 38, 39, 40 of the retaining strap 12 has a central portion 44 and a rounded portion 46, as illustrated in FIG. 3. The central portion 44 extends from the retaining strap 14, and has a generally circular cross-section, thereby forming a cylindrical extension. The central portion 44 has an axial length that is sufficiently equivalent to the thickness T of the sole 12. The rounded portion 46 has a generally circular cross-section, wherein the cross-sectional area of the rounded portion 46 is greater than the cross-section of the central portion 44. The modifiable footwear 10 are constructed such that the apertures 30, 32, 34 of the sole 12 form holes therethrough and the central portion 44 and the rounded portion 46 of each distal end 38, 39, 40 of the retaining strap 14 are inserted into the corresponding aperture of the sole 12 until the rounded portion 46 exits from the aperture on the bottom surface 22 of the sole 12. The rounded portion 46 of each distal end 38, 39, 40 is then disposed immediately adjacent to the bottom surface 22 of the sole 12 in a generally coplanar manner therewith during use in order to maintain a connection between the retaining strap 14 and the sole 12. This type of connection between the retaining strap 14 and the sole 12 allows for the retaining strap 14 to be removed and repaired or replaced in an interchangeable manner.

Figure 4:
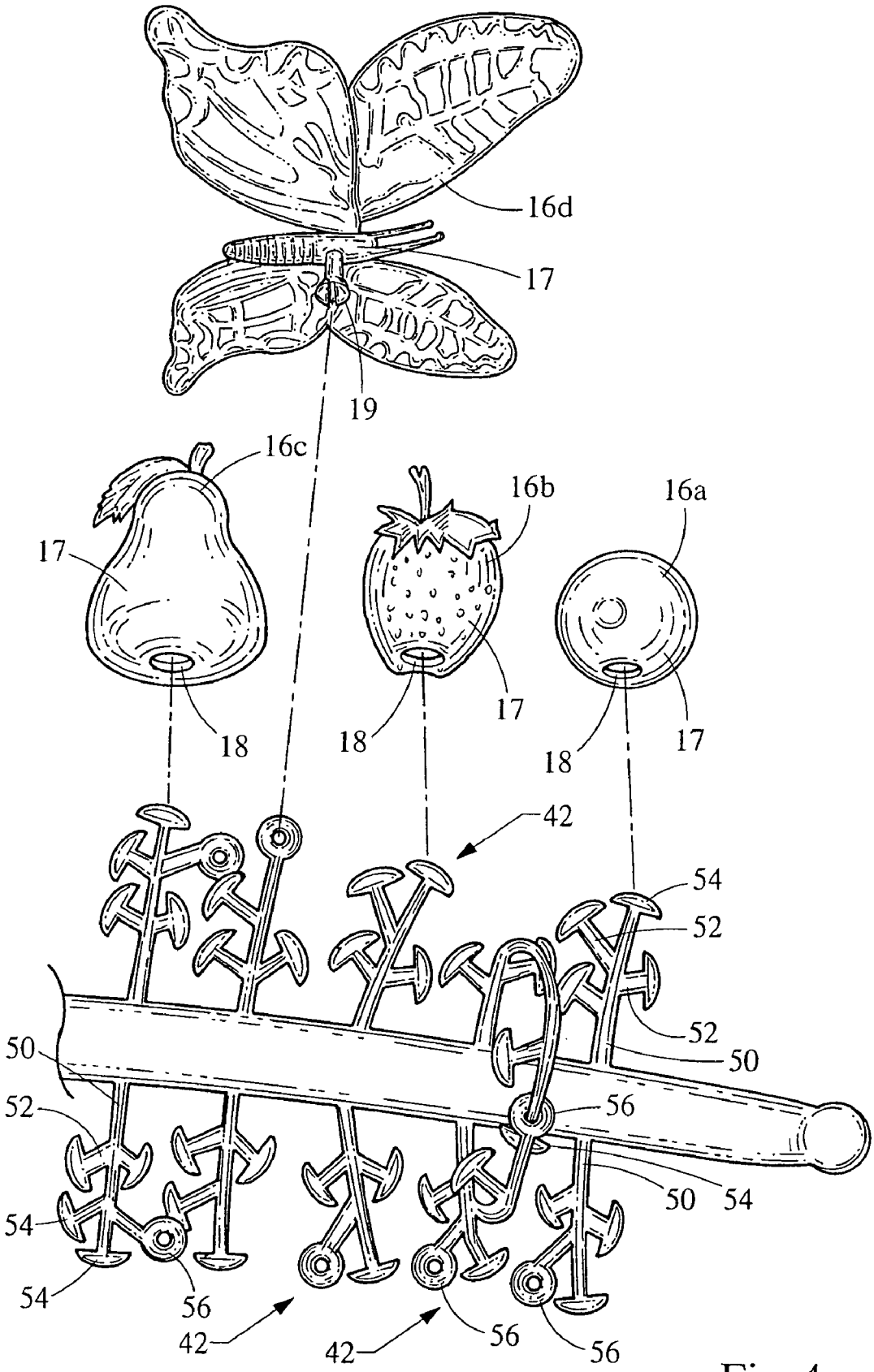
FIG. 4 is a magnified view of decorative pieces and a portion of a retaining strap.

The first arm 35 and the second arm 36 of the retaining strap 14 have at least one, and preferably a plurality of, receiving member 42 extending therefrom, as illustrated in FIGS. 3–4. The receiving members 42 are configured to receive a plurality of decorative pieces 16. As shown in FIG. 4, each receiving member 42 has a stem 50, a vine 52, and either a nodule 54 or a ring 56. The stem 50 is integrally formed with an arm 35, 36 of the retaining strap 14 and extending therefrom. A plurality of vines 52 are likewise integrally formed on each stem 50, wherein the vines 52 are attached along the length of the stem at various locations along the length, and the vines 52 extend from the stem 50 at various angles relative to the other vines 52. In addition, the vines 52 can extend from the stem 50 such that each vine 52 along the length of the stem 50 extends from an opposing side of the stem 50 as the next vine 52 along the length, or consecutive vines 52 extend from the stem from the same side of the stem 50 or a pair of vines 52 extend in opposite directions from the same point on the stem 50.

As shown in FIG. 4, a nodule 54 or a ring 56 is disposed at the distal of each vine 52 opposite the end of the vine connected to the stem 50. Each nodule 54 is disposed at the end of the vine 52 having a generally transverse orientation with respect to the length of the vine 52. The nodule 54 provides a pair of projections extending from the vine 52 that are configured to be received by a decorative piece 16. The ring 56 is likewise disposed at the end of the vine 52, and the ring 56 has a hole formed therethrough for receiving a projection formed on a decorative piece 16. In addition, two receiving members 42 extending in opposite directions from the retaining strap 14 can be connected to form a generally circular enclosure with the retaining strap 14. For example, a ring 56 disposed on one receiving member 42 is adapted to receive a nodule 54 of a receiving member 42 extending in the opposite direction on the retaining strap. The circular structure formed by connecting a ring 56 on one receiving member 42 to a nodule 54 on a receiving member 42 connected to the opposing edge of the retaining strap 14 provides the modifiable footwear 10 with a three-dimensional framework to which the decorative pieces 16 can be attached, thereby presenting a textured appearance having volume that is generated by the addition of various decorative pieces 16. The projections of the nodule 54 are flexible so as to allow the nodule 54 to be inserted into the ring 56 in a removable manner. In addition, the projections of the nodule 54 preferably form a T-shape with respect to the vine 52 to which it is attached.

The retaining strap 14 is preferably molded as a one-piece body in which the receiving members 42 are integrally formed therewith. It should be understood by one skilled in the art that the receiving members 42 can also be connected to the retaining strap 14 in a manner that allows the location of the receiving members 42 to be modifiable along the length of either the first arm 35 or the second arm 36 of the retaining strap 14. The retaining strap 14 is preferably made of a flexible material that allows the first and second arms 35, 36 to bend and form to the shape of the wearer's foot. The flexibility of the material should also allow for the receiving members 42 to be compliant to allow each of the vines 52 and corresponding nodule 54 or ring 56 to be adjustable independent of adjacent vines 52 relative to the stem 50. An exemplary material for the retaining strap 14 is a molded plastic, but any other material sufficient to provide flexure of the retaining strap and receiving members can be used.

Referring to FIG. 4, several embodiments of a decorative piece 16 are shown. In the exemplary embodiments, the decorative piece 16*a* is a grape, the decorative piece 16*b* is a strawberry, the decorative piece 16*c* is a pear, and the decorative piece 16*d* is a butterfly. The decorative pieces 16*a*–16*c* are illustrated as fruit, but it should be understood by one skilled in the art that the decorative piece can be of any shape sufficient to be capable of being attached to the retaining strap 14. The decorative pieces shown as 16*a*–16*c* have a main body 17 with an orifice 18 formed therein. The decorative piece shown as 16*d* has a main body 17*b* and a protrusion 19 extending therefrom. The orifice 18 is adapted to receive a nodule 54 of a receiving member 42, and the protrusion 19 is adapted to be received by a ring 56 of a receiving member 42. Each decorative piece 16 preferably has either an orifice 18 or a protrusion 19 so that the decorative piece 16 can be removably connected to a receiving member 42 on a retaining strap 14 of the modifiable footwear 10, thereby allowing for the removal or exchange of at least one decorative piece 16 so as to modify the appearance of the modifiable footwear 10.

The main body 17 of a decorative piece 16 having an orifice 18 formed therein is preferably hollow and made of a flexible material to allow for relatively easy removal and replacement of the decorative piece 16 with respect to a nodule 54. The decorative piece 16 having an orifice 18 is preferably plastic formed by a roto molding operation, wherein the thickness of the main body 17 can be readily deformable in an elastic manner. The deformability of the decorative piece 16 allows the wearer to grasp the decorative piece by squeezing the outer surface of the main body 17 using at least two fingers. When the wearer releases the decorative piece 16, the elasticity of the material causes the main body 17 to attain the original shape of the decorative piece 16. It should be understood by one skilled in the art that any type of material sufficient to allow flexure of the main body 17 or the orifice 18 as the decorative piece 16 is attached to, or removed from, a receiving member 42 can be used.

The orifice 18 of a decorative piece 16 is generally circular and has a diameter that is preferably less than the longest length of the nodule 54 being inserted into the main body 17 of the decorative piece 16 for attachment of the decorative piece 16 to the receiving member 42. One method of disposing a decorative piece 16 having an orifice 18 onto a receiving member 42 is performed by bending a t-shaped nodule 54 relative to the vine 52 to which it is attached, and inserting one projection of the nodule 54 through the orifice 18 and into the hollow main body 17 of the decorative piece 16. The remainder of the nodule 54 is then inserted through the orifice 18 and into the main body 17 of the decorative piece 16 until the entire nodule 54 resides within the main body 17. The decorative piece 16 maintains a removable connection with the nodule 54 of the receiving member 42 because the projections of the nodule 54 are located immediately adjacent to the inner surface of the main body 17 of the decorative piece 16 about the orifice 18, preferably in an abutting manner with the inner surface. It should be understood by one skilled in the art that any other method of attaching a decorative piece to a receiving member sufficient to provide a removable connection can be used. Alternative methods of attaching a decorative piece 16 to a receiving member 42 includes, but not limited to: 1) a snap disposed on the decorative piece and a corresponding snap disposed on the receiving member; 2) Velcro®; 3) a releasable loop attached to the decorative piece configured to surround the retaining strap and capable of movement thereon; and 4) a removable thread having at least one stitch.

One method of removing a decorative piece 16 having an orifice 18 can be performed by squeezing the main body 17, thereby deforming the orifice 18 such that an generally oval-shaped opening results, and the decorative piece 16 is maneuvered such that one of the projections of the nodule 54 exits orifice 18. The main body 17 is pulled in a direction away from the retaining strap 14 in a manner causing the remaining portion of the nodule 54 to exit the main body 17, thereby separating the decorative piece 16 from the receiving member 42.

A decorative piece 16 having a protrusion 19 extending from the main body 17 is configured to be removably connected to a ring 56 on a receiving member 42. The main body 17 of the decorative piece 16 having a protrusion 19 is shown as a butterfly in FIG. 4, but it should be understood by one skilled in the art that the main body can be any form chosen by the wearer and need not be limited to an insect. The protrusion 19 is generally cylindrical and is located on the underside of the main body 17 so that when the decorative piece 16 is attached to the receiving member 42 the ornamentality is directed outward from the sole 12. The distal end of the protrusion 19 opposite the end connected to the main body 17 is preferably slightly larger than the portion of the protrusion 19 between the distal end of the protrusion 19 and the main body 19.

The method of attaching a decorative piece 16 having a protrusion 19 includes inserting the enlarged distal end of the protrusion 19 into the hole formed in a ring 56 on a receiving member 42. The enlarged distal end portion of the protrusion 19 is preferably larger in diameter than the hole in the ring 56 through which the protrusion 19 is inserted. Insertion of the protrusion 19 into the ring 56 causes the enlarged distal end of the protrusion 19 to be reduced in size. Because the diameter of the enlarged portion of the protrusion 19 is greater than the hole in the ring 56, once the enlarged portion completely passes through the ring 56, the enlarged portion of the protrusion 19 tends to expand to attain the original diameter of the enlarged portion of the protrusion 19. This expansion of the distal end of the protrusion 19 creates a secure connection between the decorative piece 16 and the receiving member 42. The secure connection also allows for the decorative piece 16 to be removed by pulling on the main body 17 of the decorative piece 16 causing the protrusion 19 to withdraw from the ring 56. Thus, the protrusion 19 on the decorative piece 16 provides a removable connection between the decorative piece 16 and the modifiable footwear 10. It should be understood by one skilled in the art that any other type of connection having a protrusion on a decorative piece being received by a receiving member on the modifiable footwear can be used.

In an alternative embodiment of the modifiable footwear 10, not shown, a plurality of decorative pieces are fixedly attached to receiving members on a retaining strap. The retaining strap is releasably connected to the sole such that modification of the modifiable footwear 10 involves removing the entire retaining strap having decorative pieces attached thereto and replacing the retaining strap with a second retaining strap having a different visual appearance.

The ability for the wearer to remove the retaining strap 14 or individual decorative pieces 14 allows the wearer to customize the appearance of the modifiable footwear 10 by removing and replacing either of these components with others. The wearer can customize the modifiable footwear 10 to have a particular theme that is common amongst each of the decorative pieces 16.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. Footwear comprising:

a sole;

a foot-retaining strap attached to said sole;

at least one receiving member attached to said foot retaining strap, wherein each of said at least one receiving members includes a stem and an extension from said stem;

and at least one decorative piece removably connected to said foot retaining strap.

2. The footwear of claim 1, wherein said foot retaining strap is removably attached to said sole.

3. The footwear of claim 1, wherein said foot retaining strap is fixedly attached to said sole.

4. The footwear of claim 1, wherein said at least one receiving member is fixedly attached to said foot retaining strap.

5. The footwear of claim 1, wherein said at least one receiving member is removably attached to said foot retaining strap.

6. The footwear of claim 1, wherein the extension from the stem comprises a plurality of vines extending from said stem.

7. The footwear of claim 6, wherein a ring is attached to a distal end of one of said plurality of vines.

8. The footwear of claim 7, wherein said ring has a hole formed therethrough.

9. The footwear of claim 6, wherein a nodule is attached to a distal end of one of said plurality of vines.

10. The footwear of claim 9, wherein said nodule is T-shaped.

11. The footwear of claim 1, wherein said decorative piece is hollow.

12. The footwear of claim 11, wherein said decorative piece has an orifice formed thereon.

13. The footwear of claim 12, wherein said decorative piece is shaped as a piece of fruit.

14. The footwear of claim 12, wherein said foot retaining strap includes a receiving member attached thereto, and said receiving member includes a nodule, wherein said orifice of said decorative piece is adapted to receive said nodule of said receiving member in a releasable manner.

15. A method for modifying footwear comprising:

providing a sole and a foot retaining strap attached thereto with at least one receiving member attached to said foot retaining strap, wherein each of said at least one receiving members includes a stem and an extension extending from said stem;

removing a first decorative piece from said foot retaining strap;

and connecting a second decorative piece to said foot retaining strap.

16. The method of claim 15, wherein at least one of said decorative pieces is shaped as a piece of fruit.

17. The method of claim 15, wherein at least one of said decorative pieces is shaped as an insect.

18. Footwear comprising:

a sole;

a foot retaining strap attached to said sole;

said foot retaining strap including a plurality of receiving members integrally formed thereon, and each of said plurality of receiving members includes: a stem, at least one vine extending from said stem, and one of a ring and a nodule is attached to a distal end of said at least one vine; and one or more of:

(a) at least one decorative piece, wherein said at least one decorative piece is hollow and has a main body and an orifice formed in said main body, said orifice being adapted to receive said nodule in a releasable manner; or (b) at least one decorative piece, wherein said at least one decorative piece having a main body and a protrusion extending from said main body, said ring being adapted to receive said protrusion in a releasable manner.

19. The footwear of claim 1, wherein said decorative piece has a protrusion extending therefrom.

20. The footwear of claim 14, wherein said foot retaining strap includes a receiving member attached thereto, and said receiving member includes a ring, wherein said ring is adapted to receive said protrusion of said decorative piece in a releasable manner.

* * * * *